United States Patent [19]

Fellows

[11] Patent Number: 4,779,421

[45] Date of Patent: Oct. 25, 1988

[54] HOT GAS ENGINE

[76] Inventor: Oscar L. Fellows, P.O. Box 201207, Austin, Tex. 78720

[21] Appl. No.: 84,757

[22] Filed: Aug. 13, 1987

[51] Int. Cl.[4] ..... F02G 1/04

[52] U.S. Cl. ..... 60/525; 60/517

[58] Field of Search ..... 60/517, 519, 525

[56] References Cited

U.S. PATENT DOCUMENTS

| | | | |
|---|---|---|---|
| 3,403,508 | 10/1968 | Kelly | 60/525 |
| 4,290,264 | 9/1981 | Haines | 60/525 X |
| 4,677,825 | 7/1987 | Fellows | 60/525 |

*Primary Examiner*—Stephen F. Husar

[57] ABSTRACT

A hot gas engine which uses elliptical members in place of gears or connecting rod linkages to couple the reciprocating pistons to the central shaft of the machine, thereby reducing friction and overall size of the machine, reducing weight to power ratios and increasing efficiency. The elliptical members are so designed as to provide two power strokes per revolution of the central shaft, and the piston and cylinder arrangement is such that they spiral around the body of the machine, allowing a very compact engine.

2 Claims, 11 Drawing Sheets

HOT GAS ENGINE

BACKGROUND OF THE INVENTION

Stirling-cycle engines, sometimes called hot-air engines or hot-gas engines, are well known, as evidenced by more than 600 original and related patents, and are a genre of machines chiefly characterized by an operating process in which an internally contained quantity of gas is alternately and periodically heated and cooled, via conduction, through the walls of parts of the machine, by an external heat source and an external heat sink, in order to perform work.

These engines are attractive because of their high theoretical efficiency, their ability to utilize a large variety of fuels or energy sources, and their potential for reducing hydrocarbon emissions.

The chief difficulties inhibiting the commercial exploitation of these engines presently are that they must have high internal pressures in order to have a high specific output or efficiency or power-to-weight ratio; they must have high temperature, high pressure, dynamic seals to prevent escape of the working gas, and to separate machine lubricants from the working gas, because such mixing or contamination reduces the efficiency of the engines, and these requirements have heretofore resulted in unacceptable expense in the manufacture of these engines. Higher pressures usually result in heavier machines because the machine sections must be stronger in order to contain the internal forces, and as the engines increase in size in order to achieve higher horsepower, the weight and cost of these sections becomes impractical.

In addition to being a pressure vessel, the Stirling-cycle engine must maintain the greatest possible temperature differential between the hot side and the cold side of the engine. Therefore, conduction through the engine body and working parts must be minimized through selection of materials and through designs which reduce conductive pathways.

Lastly, the Stirling, in order to compete successfully with existing engines, must be cheap to produce, with no major retooling or special production equipment, and it must be reasonably easy to maintain, and have a service life comparable to existing internal-combustion engines of equivalent performance.

These and other considerations, as well as a history of the technical development of Stirling engines are set forth in a book by G. Walker entitled, "Stirling Cycle Machines", and by the Philips Technical Review, vol. 31, "Prospects of the Stirling engine for Vehicular Propulsion".

U.S. Pat. No. 4,677,825 addresses these considerations, and overcomes or alleviates many of the difficulties preventing widspread use of Stirling-cycle machines. The invention described herein is an improvement of the mechanical arrangement of certain parts and components of the thermomotor described in the aforementioned patent (thermomotor is a noun which refers, according to the new college edition of the American Heritage Dictionary, published by Houghton Mifflin Company of Boston, Mass., to "An engine operated by heat, especially by the expansion of heated air."). The general configuration and operation of the heater head and displacer piston remain the same as in U.S. Pat. No. 4,677,825, as do the thermal breaks, regenerative devices, electrical-induction coupling system and associated housing. The pistons still operate in unison, but are coupled to the displacer shaft by other means; such means being the primary object of the new invention.

SUMMARY OF THE INVENTION

The invention consists of an improved design of the body of the machine described in U.S. Pat. No. 4,677,825, and of the coupling means by which the pistons and displacer shaft are related.

The displacer piston reciprocates twice for each revolution of the displacer shaft, so too, the pistons must reciprocate twice for each revolution of the displacer shaft, in order for the engine to operate. This was achieved in the old design by means of reduction-gearing the piston crankshafts to the displacer shaft. This means was effective, but the diameter of the engine was larger than desired, due to the diameter and placement of the gears, and unwanted friction was inherent in the gear train.

This improved design makes for a more compact engine and reduces friction by substituting elliptical driven/driving members in place of gears.

The basic parts, or core of the machine, consists of two cylinders, one within the other, which form the engine housing and cooling water jacket. At one end of the housing is the heater head, and at the other end is the sealed housing which contains the electromagnetic-induction coupling apparatus or alternator, as the case may be. The rotor of this apparatus is fixed to the displacer shaft, which is disposed parallel to the central axis of the housing, and inside the innermost cylinder, and which has at its opposite end, the displacer-drive mechanism which causes the displacer piston to reciprocate within the heater head. This displacer shaft, with the induction rotor on one end and the displacer drive on the other, rotates within the cylindrical housing that comprises the body of the machine.

The body, or cylindrical housing, consists of two sections of pipe or tubing, one of smaller diameter fitting inside one of larger diameter, with multiple piston-cylinders distributed radially around the space between the two pipes, like spokes in a wheel. These piston-cylinders communicate from the exterior of the outermost pipe to the interior of the innermost pipe, through the walls of the pipe sections.

The piston-cylinders also lie in a spiral configuration about the central core, so that the piston-cylinders form opposing pairs on several planes along the length of the body. Each plane has two cylinders 180° apart around the circumference of the body, so that four planes make an eight-cylinder machine. There can be more or less planes, and consequently, more or less cylinders. This describes the core of the machine. Hereafter, either of two mechanical arrangements will complete the machine.

The first arrangement consists of a means for connecting the pistons to the displacer shaft through use of round plates with elliptical cutouts in their centers. The body of the machine fits through the elliptical cutouts in the plates, so that the plates rotate around the exterior of the machine body. In an eight cylinder machine, four plates would be stacked one-atop-the-other, and turned so that each succeeding plate is situated with the elliptical center at a 45° angle (with respect to the long diameter) to the previous plate, in order to match the cylinders of the machine which are also at 45° angles between successive pairs, around the circumference of the central core. As a plate revolves, the inner surface of the ellipse contacts rollers on the bottoms of two opposing pistons on one of the planes about the core, causing the pistons to reciprocate within the piston-cylinders as the major and minor diameters of the ellipse contacts the piston rollers. Four stacked plates, oriented at 45° angles to match the orientation of four cylinder planes, would comprise an eight cylinder machine, all pistons operating in unison, and making two strokes per revolution of the plates. The plates are affixed to the central displacer shaft, so that the pistons reciprocate in a fixed relationship to the reciprocation of the displacer piston.

The second arrangement places the connecting means on the central displacer shaft, rather than outside the core of the machine. These connecting means take the form of elliptical cams placed at intervals along the length of the displacer shaft, rather than as plates with elliptical cutouts, and as before, these cams are at 45° angles around the circumference of the shaft with respect to one another. Each interval along the shaft corresponds to the plane of a pair of opposing pistons whose rollers ride against the elliptical cam. The cams are double sided, so that once again, the pistons make two strokes per revolution of the displacer shaft.

Each arrangement is intended to meet a different set of requirements. Arrangement #1 has greater bulk, and greater power and torque. Arrangement #2 has less bulk and higher speed. Either arrangement comprises a machine of unique geometry, unusual to the Stirling genre of machines, which minimizes friction between the connecting parts of the machine by substituting elliptical members in place of gears and connecting-rod linkage.

The invention will be described in detail hereinafter with references to drawings which are not to scale.

DESCRIPTION OF THE PREFERRED EMBODIMENTS

Figure 1:
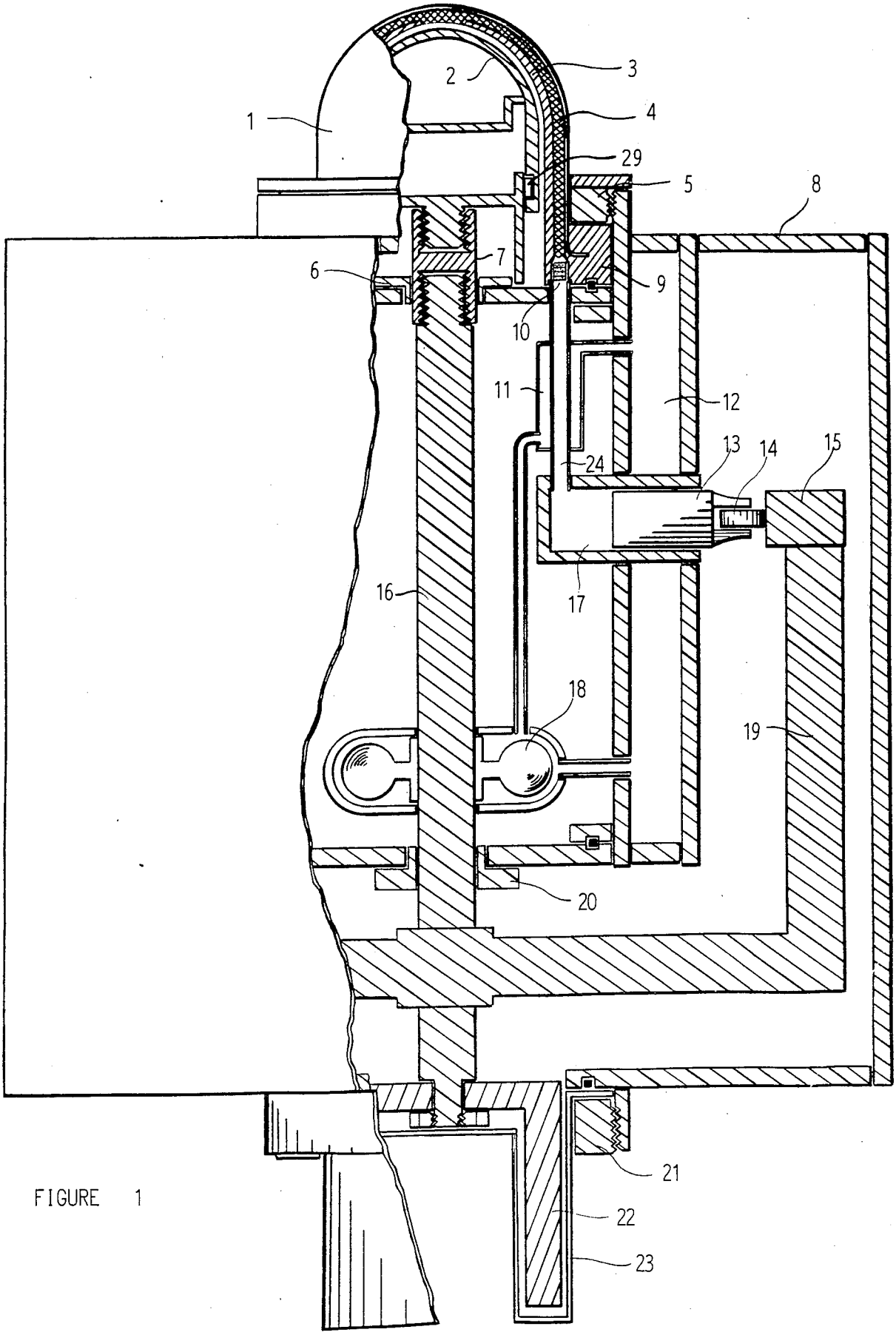
FIG. 1 is a cross-sectional view of the internal workings of the engine utilizing arrangement #1.
Figure 2:
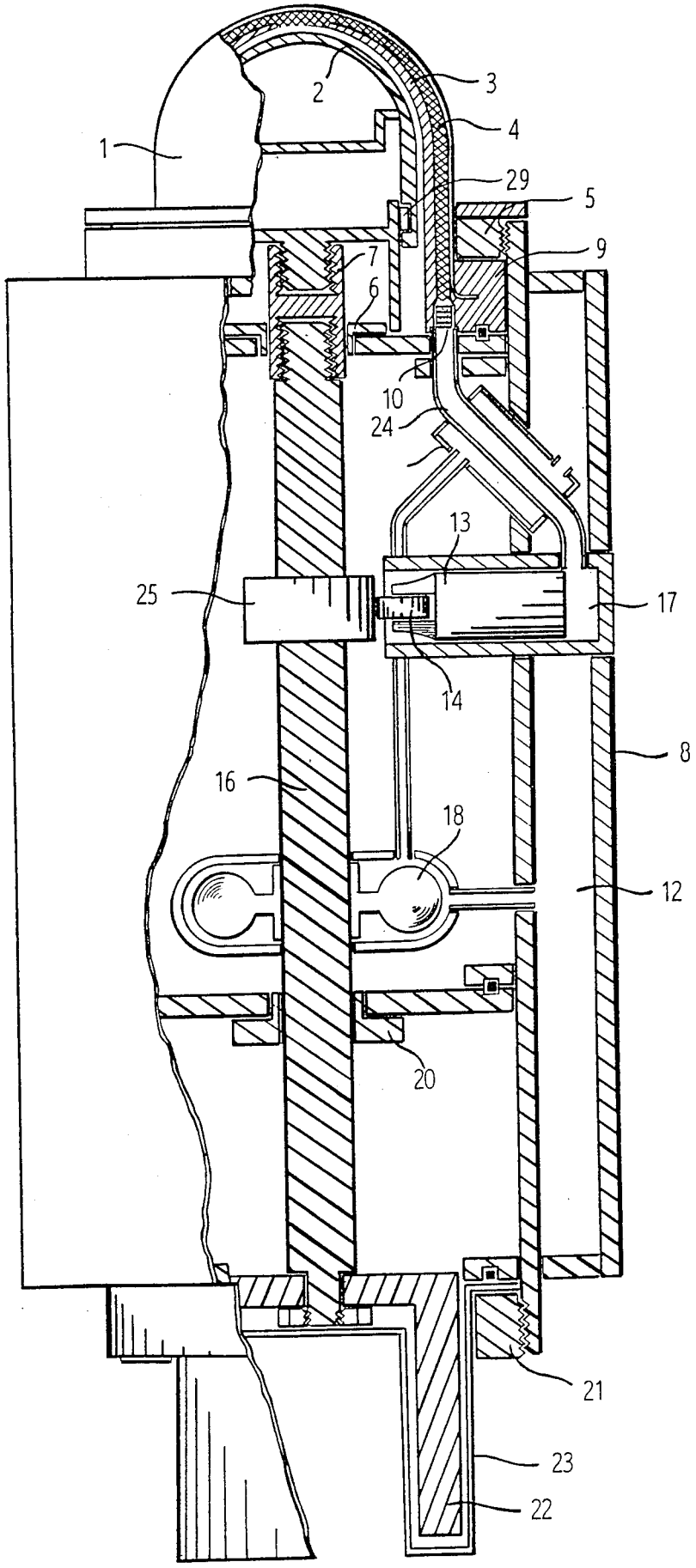
FIG. 2 is a cross-sectional view of the internal workings of the engine utilizing arrangement #2.
Figure 3:
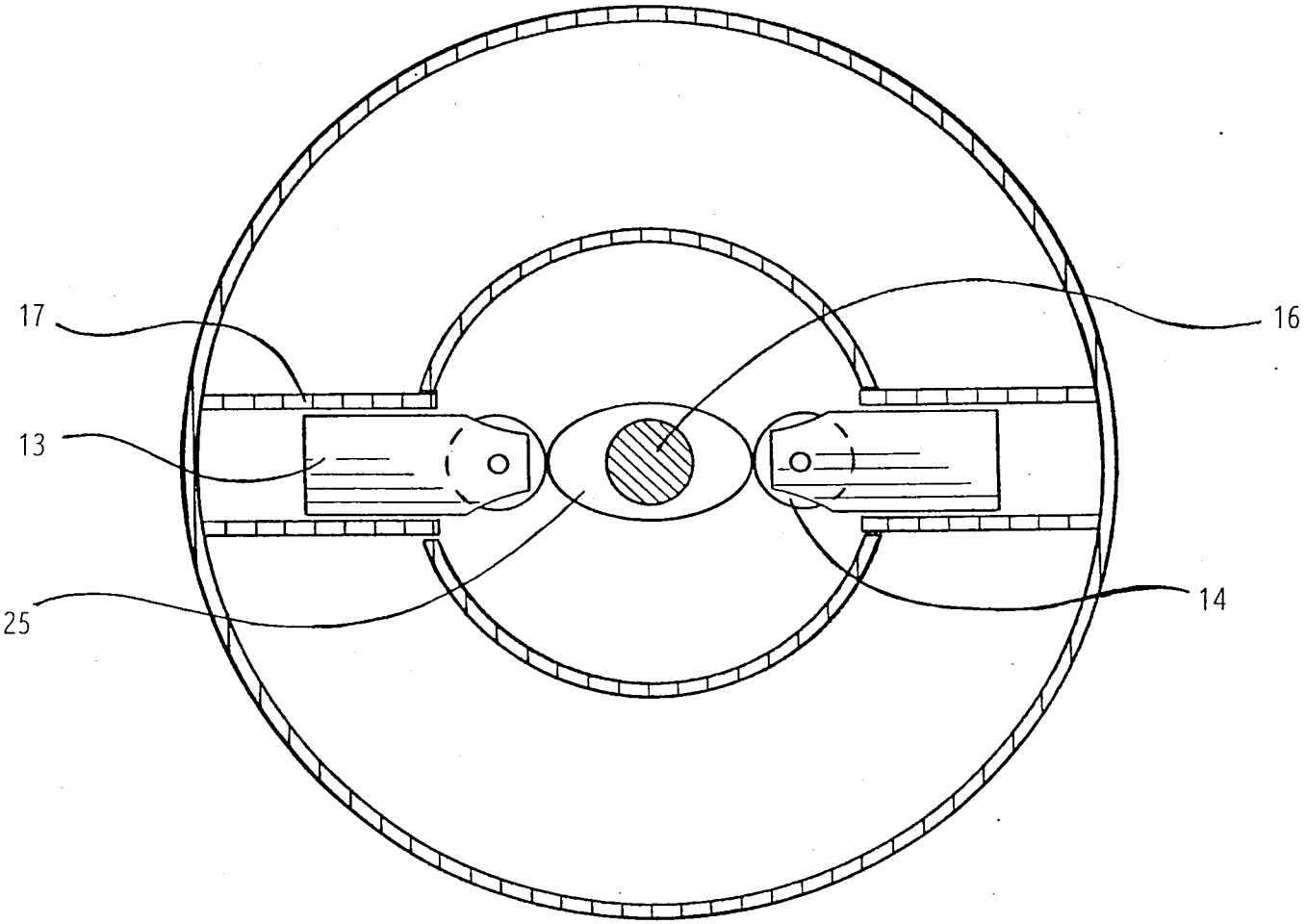
FIG. 3 is a cross-sectional view of one stage of an engine using arrangement #2.

With reference to FIG. 1, numeral 1 indicates a heater head, made up of a shell of metal alloy with an inner liner 4, of foamed or corrugated metal alloy bonded to it. A ceramic inner liner 3 sandwiches the foamed or corrugated metal 4 between it and the outer shell 1, making a confined passage through which a working fluid can flow. The base of the heater head is comprised of an integral, ceramic ring 9 which is ported for the passage of the working fluid, and which houses the regenerator pellets 10, which are comprised of porous metal discs that stack within said ports. The heater head is fastened to the engine body 8 by the threaded ring 5.

A displacer piston 2, comprised of ceramic or metal alloy, reciprocates within the heater head 1, causing the working fluid to traverse through the foamed or corrugated metal 4 and the regenerator pellets 10, into the cooling tubes 24 and cylinders 17, where the expanding fluid drives the pistons 13.

Numerals 11 and 24 indicate a tube-in-shell heat exchanger which cools the working fluid. The coolant circulates through the shell 11 and the engine water jacket 12 and through an external heat exchanger which is not shown. The coolant is circulated by the pump 18 which is situated annularly about the displacer shaft, and which is driven by said shaft 16. The displacer shaft 16 is supported within the engine body 8 by bearings 6 and 20 which also incorporate seals not shown. A ceramic coupling 7 attaches the displacer drive mechanism to the top of the shaft 16, and an electromagnetic, induction rotor 22 is attached to the opposite, or bottom, end. A gas-tight housing 23 is fastened to the engine body 8 by a threaded retaining ring 21. Said housing is permeable to magnetic and electric fields which emanate from without the engine body 8, said fields affecting electric currents and magnetic forces within the rotor 22.

The above embodiments are described fully in U.S. Pat. No. 4,677,825, with the exception of the coolant pump 18, tube-in-shell heat exchanger 11 and heater head retaining ring 5, which are similar in function and purpose to the kindred embodiments in said patent. All other aforementioned embodiments are alike in scope of function and detail, to those same embodiments described in said patent.

The following embodiments are unique to this invention, and they comprise an improved mechanical arrangement to the engine described in U.S. Pat. No. 4,677,825. FIG. #1 illustrates the first of two arrangements which are described herein. A spider 19 of alloy steel or other metal alloy is fitted to the displacer shaft 16, and rotates in unison with it. The spider 19 is attached to a plate which has an internal cutout in the shape of an ellipse 15. As the plate 15 rotates in conjunction with the spider 19, the major and minor diameters of the ellipse run in contact with the piston roller 14, causing the piston 13 to reciprocate within the cylinder 17. The elliptical surface will cause the piston 13 to reciprocate twice for each revolution of the spider 19. For each plate 15, there are a pair of opposing pistons 13 which operate in unison, as depicted in FIG. #4. The plate 15 revolves around the water jacket housing 8, and within the outer housing 26. As the minor diameter of the ellipse contacts the piston rollers 14, the pistons 13 are pushed into the cylinders, compressing the working fluid. When the working fluid expands, it drives the pistons 13 outward, and forces the plate 15 to rotate toward its major diameter, thus applying torque to the displacer shaft 16 and rotor 22 in FIG. #1. Each pair of pistons 13 require one plate 15, and a multiple piston machine is accomplished by locating opposing pairs of pistons 13 along the length of the engine body 8 to coincide with plates 15 stacked one atop the other, on the spider 19.

FIG. #2 illustrates arrangement #2, wherein an alternate method of connecting the pistons 13 to the displacer shaft 16 is accomplished by means of an elliptical cam 25 fitted to the displacer shaft 16. The pistons 13 face outboard, rather than inboard as in FIG. 1, and the physical location of the cooler tube 24 and shell 11 are slightly different, but otherwise, the operation of the machine is the same as in arrangement #1.

FIG. #3 depicts the operation of the engine as the cam 25 rotates, causing the pistons 13 to reciprocate. As can be seen, the machine in FIG. #3 is a more compact machine than that in FIG. #4, and it should produce greater shaft speed, while the machine in FIG. #4 should produce greater torque, due to its greater leverage.

FIG. #5 and FIG. #6 depict the basic core of the machine, which is common to both mechanical arrangements. The cylinders 17 are spaced around the body 8 at 45° intervals in order to conserve space and reduce the length of the body 8. In this way, eight cylinders 17 can be accomodated in a band about the body 8 only a few inches in width.

Four elliptical plates 15 or cams 25 are needed to operate eight pistons 13.

The inner core consists of a tubular section inside a larger tubular section 8, with the cylinders 17 spiraled around and between the two sections of tubing at 45° intervals, like spokes in a wheel. Any reasonable number of cylinders is possible by simply continuing to space them about the body 8 like the spiral stripe around a barber pole.

FIG. #7 depicts a series of cams as used in arrangement #2, illustrating the spacing and angle of the cams 25 about the displacer shaft 16.

FIG. #8 is an exploded view of a series of plates 15 as used in arrangement #1, showing their angles with relation to each other.

FIG. #9 is a side view of the assembled plates 15.

FIG. #10 is an x-ray view of the assembled plates, as seen from the top of the stack.

FIGS. #11 and #12 are cross-sectional views of the assembled engines, showing arrangement #2 and arrangement #1, respectively.

FIGS. #13 and #14 illustrate how a groove 27 is machined into the plate 15 or cam 25, and the roller 14, fitted to the pin 28 of the piston 13, is made to ride within the groove 27 in order to make the engine double-acting. By this means, both the inward and outward strokes of the piston are coupled to the motion of the plate 15 or cam 25.

FIG. #15 illustrates the displacer-drive mechanism, which is comprised of two rollers 29 affixed to the sides of the displacer shaft head 31, said rollers 29 riding in an eccentric groove 30 which is machined into the inside skirt of the displacer piston 2. As the displacer shaft head 31 rotates, the rollers 29 traverse along the groove 30, causing the piston 2 to reciprocate into, and out of the heater head 1.

Figure 4:
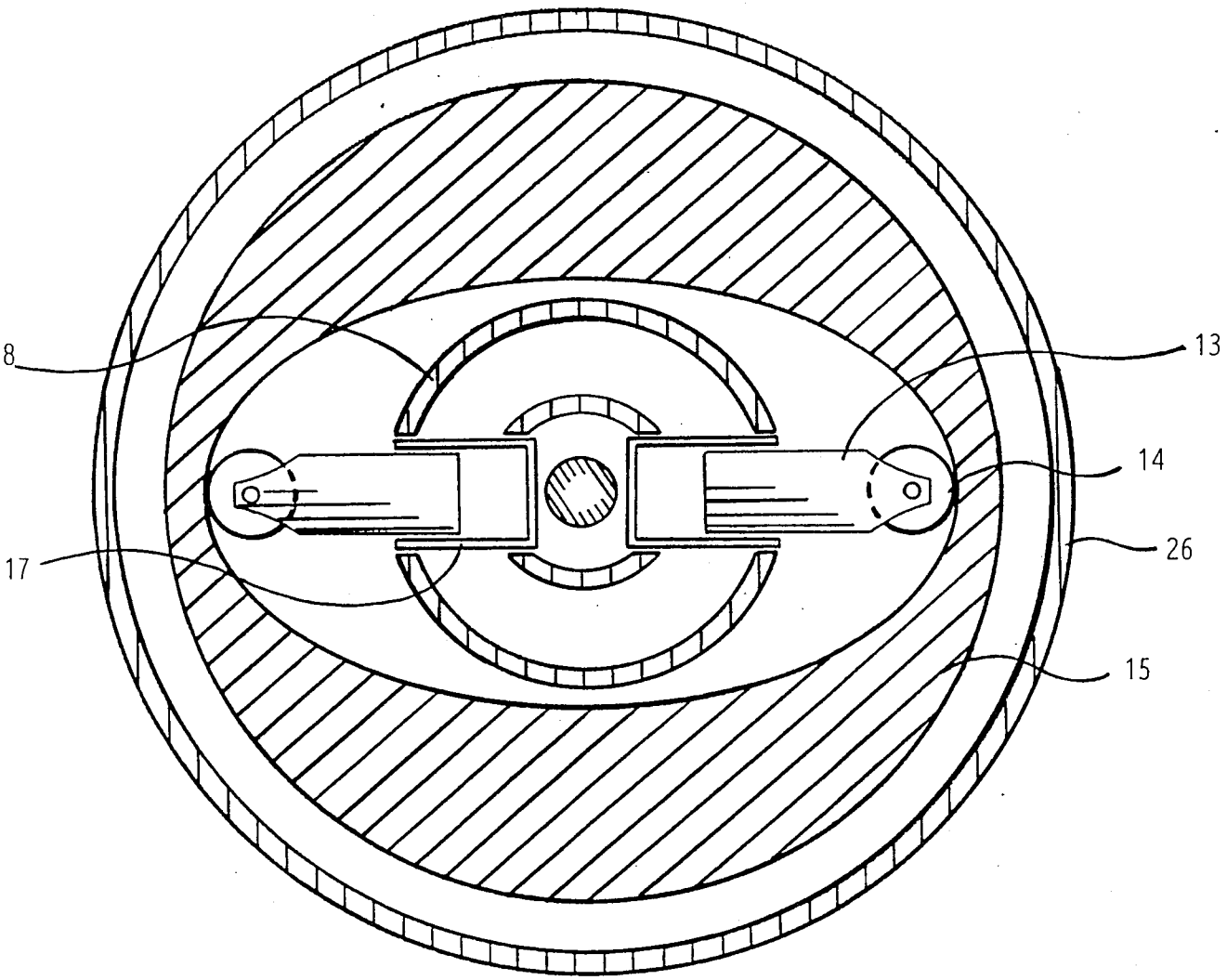
FIG. 4 is a cross-sectional view of one stage of an engine using arrangement #1.
Figure 5:
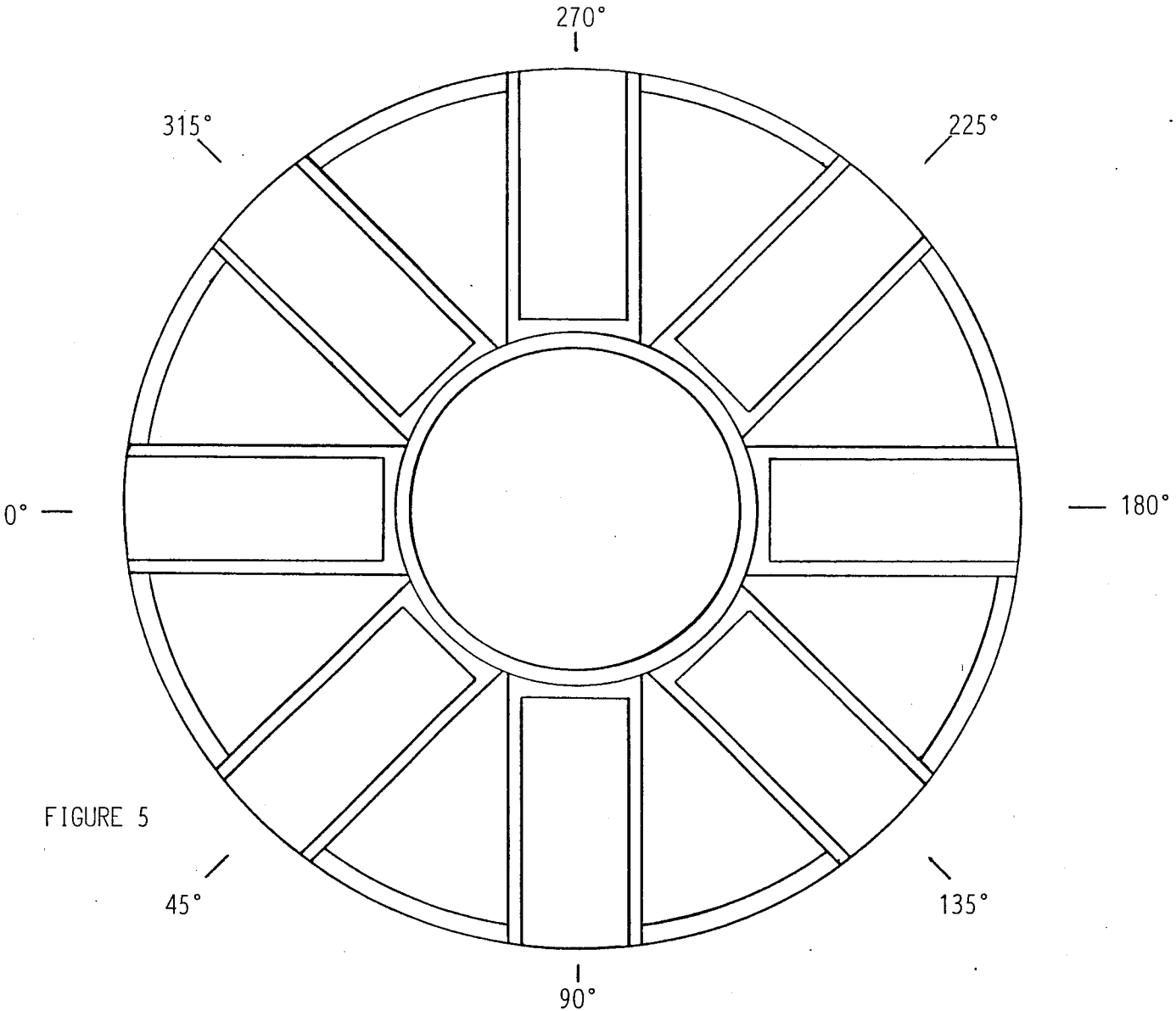
FIG. 5 is an end-on view of the portion of the engine body that is common to both arrangements.
Figure 6:
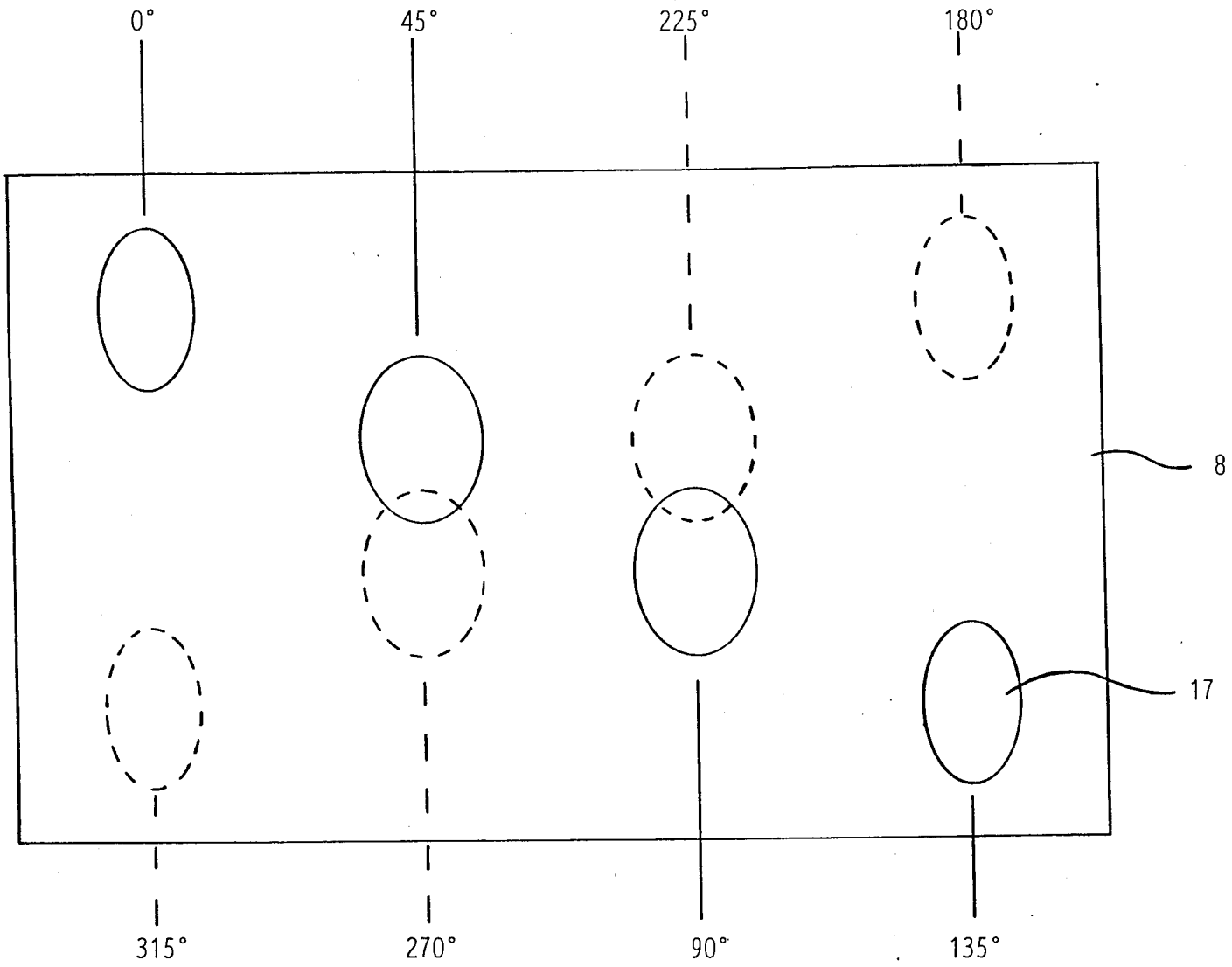
FIG. 6 is a side view of the portion of the engine body that is common to both arrangements.
Figure 7:
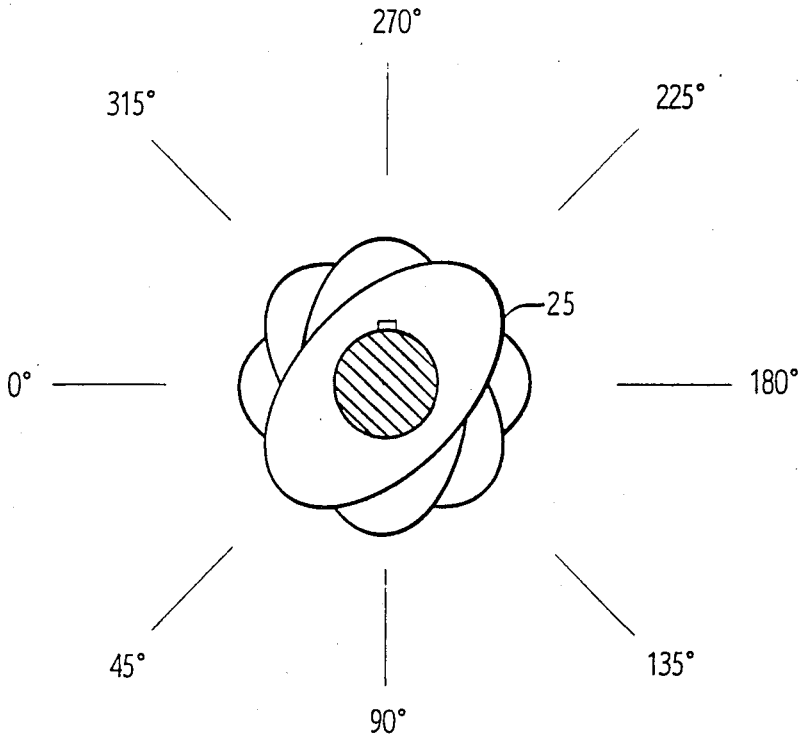
FIG. 7 is a cross-sectional view of the displacer shaft utilized in arrangement #2, showing the succeeding arrangement and relative angles of the cam lobes.
Figure 9:
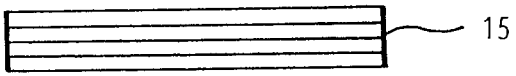
FIG. 9 is a side view, and FIG. 10 an x-ray view of the stacked plates.
Figure 10:
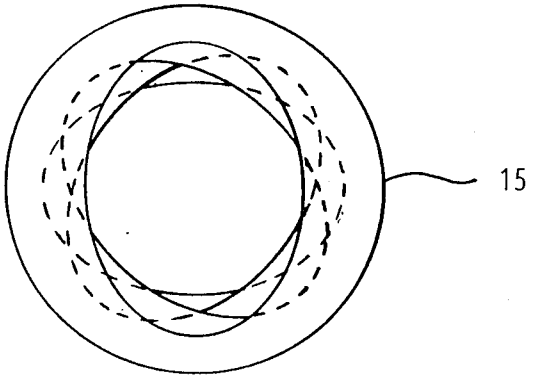
Figure 8:
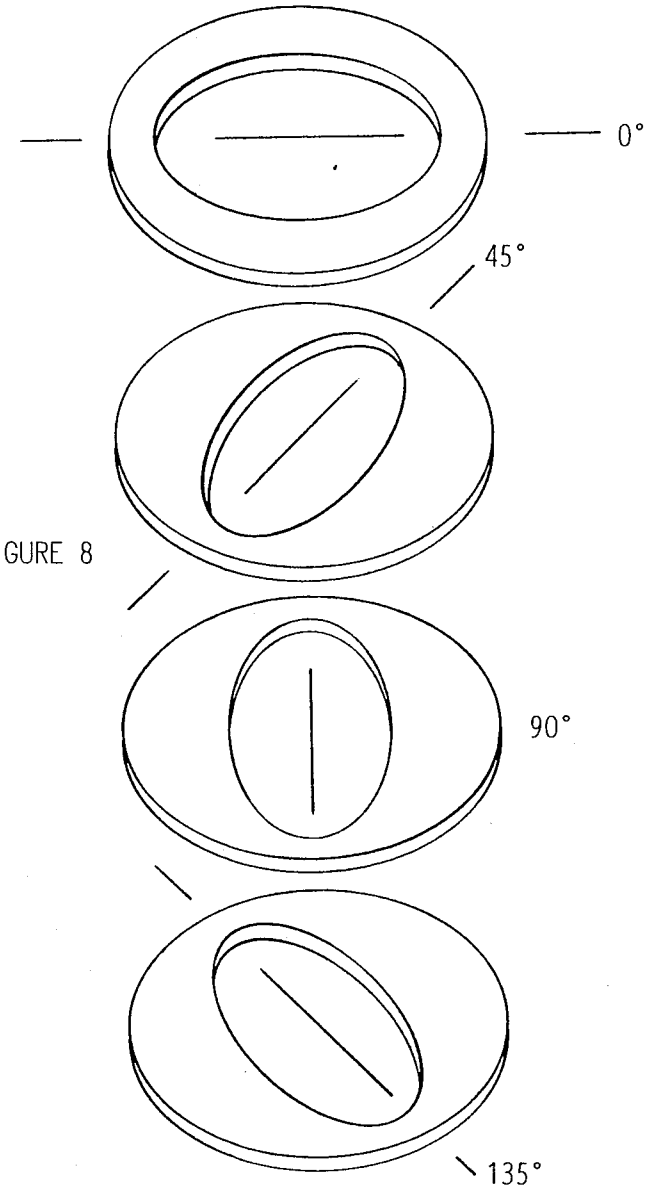
FIG. 8 is an exploded view of succeeding elliptical plates and their angles relative to one another, as they would be in arrangement #1.
Figure 12:
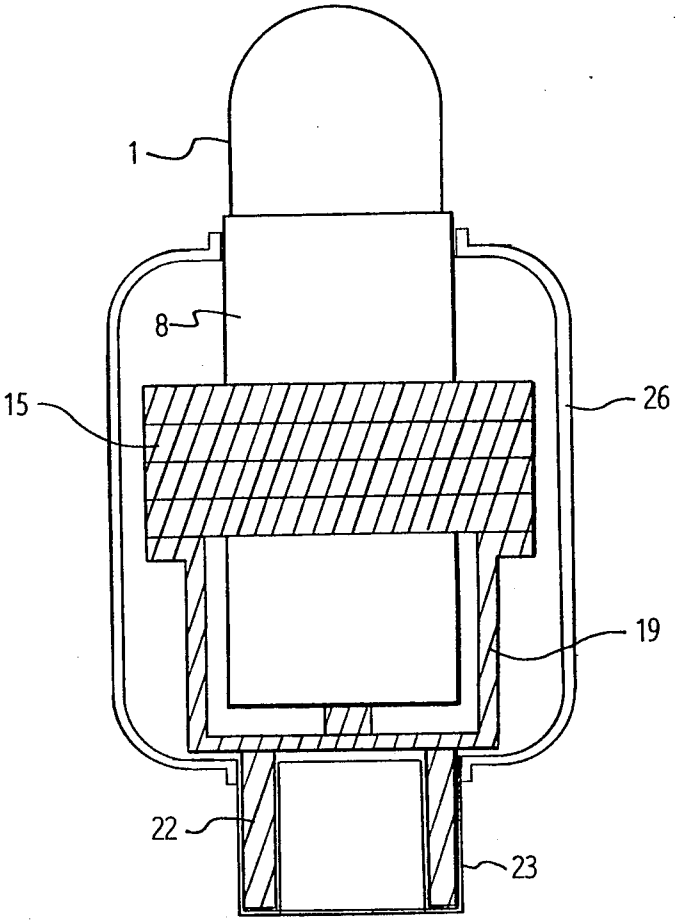
FIGS. 11 and 12 are cross-sectional views of the assembled engines.
Figure 11:
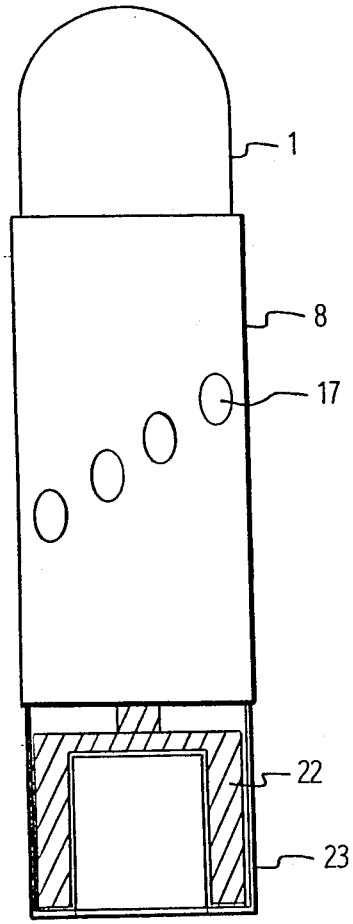
Figure 14:
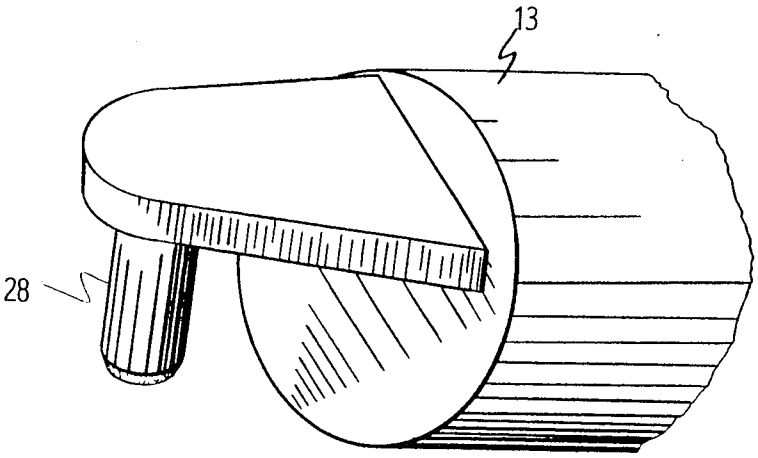
FIGS. 13 and 14 show an optional elliptical groove in the plate or cam.
Figure 13:
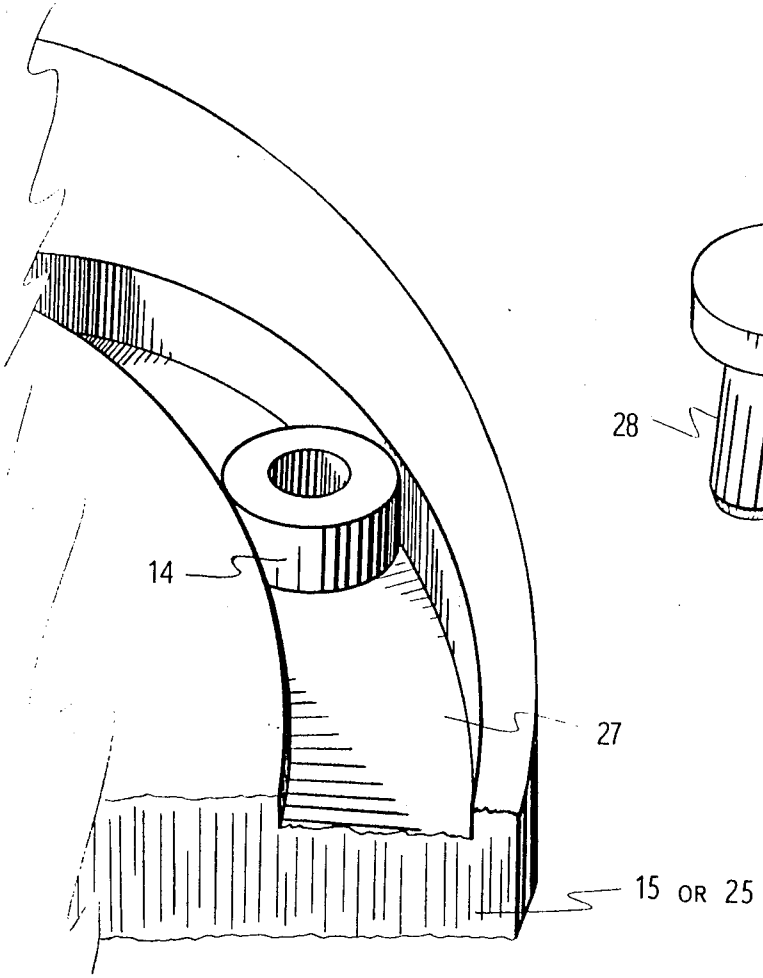
Figure 15:
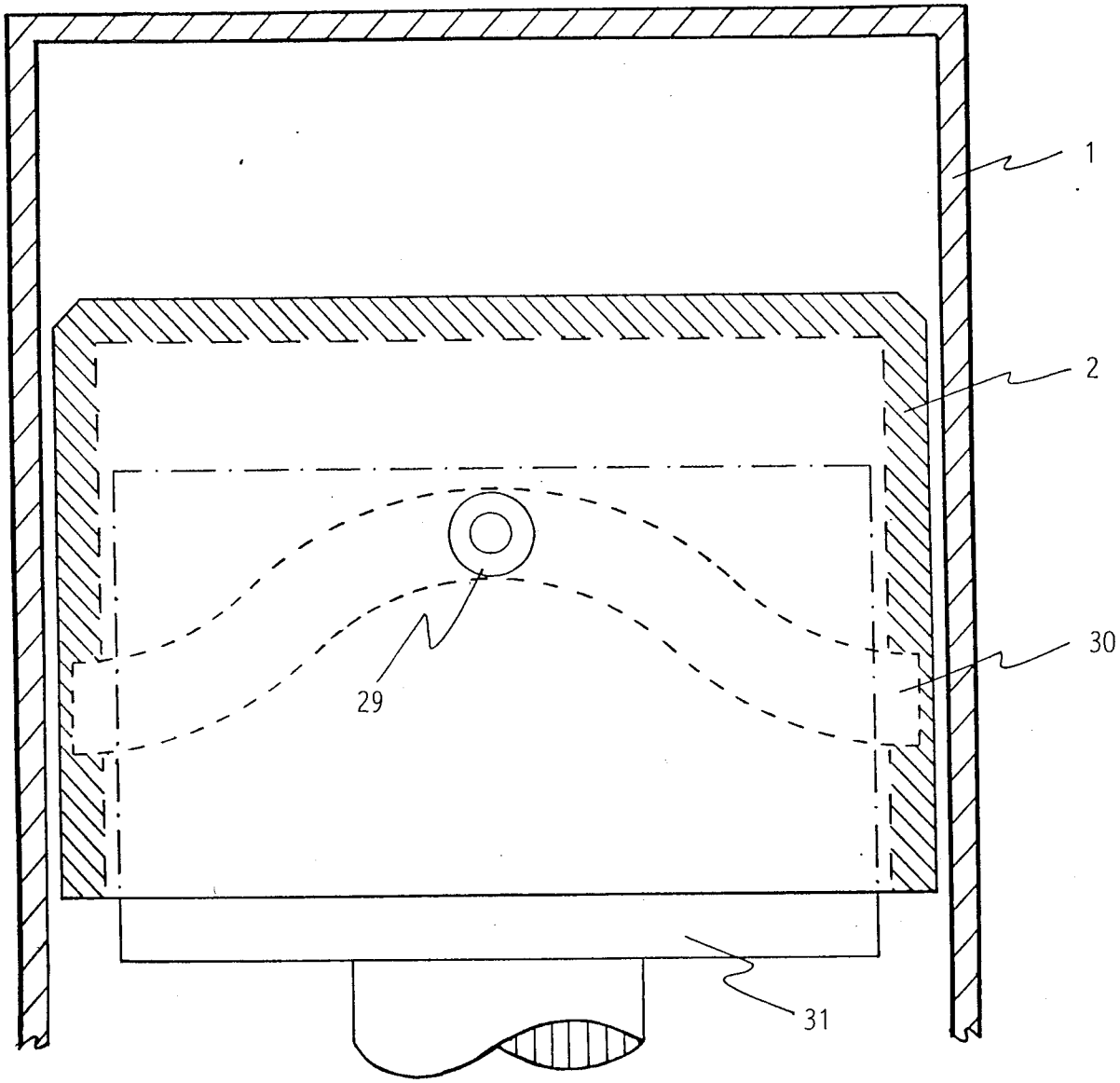
FIG. 15 shows the displacer drive mechanism.

The following claims for this invention distinguish it from the prior art in U.S. Pat. No. 4,677,825, Fellows, and U.S. Pat. No. 4,290,264, Haines, by describing an entirely different mechanism for translating the motion of the pistons into rotary shaft motion. In Fellows U.S. Pat. No. 4,677,825; the reciprocating motion of the pistons is translated to the displacer shaft through connecting rods and gears. In Haines' U.S. Pat. No. 4,290,264; the pistons are connected by means of connecting rods, to a circular plate which rotates a few degrees in one direction, then reverses and rotates a few degrees in the opposite direction, causing the attached pistons to reciprocate. This invention is distinguished from Kelly's U.S. Pat. No. 3,403,508; in the same respect. In Kelly's patent, a wave-cam disc mounted on the output shaft, connects the power pistons and displacer pistons to the shaft, and regulates the respective timing of the pistons, so that they operate in sequential pairs. When P1 and P3 are at the top of their stroke (FIG. 4), P2 and P4 are at the bottom of their stroke. This application, Ser. No. 084,757; describes elliptical members affixed or attached to a rotary displacer shaft, said elliptical members driving two opposing pistons per plane, in a method calculated to cause all pistons to operate in unison. These elliptical members are not similar to any of the three cited patents, in design, nor in the exact way in which they relate the motion of the pistons to the motion of the displacer, and are not obvious extrapolations of prior art.

Haines' displacer is driven by a cam-driven toggle, said cam being powered by an electric motor and gear arrangement. Kelly's displacer pistons are disposed parallel to his power pistons, a dedicated displacer adjacent to each piston, both operated by the wave-cam disc on the output shaft. Neither Haines' nor Kelly's displacer drive resemble that of Fellows', and none have any relation to the piston/displacer-shaft connecting means described in this specification.

I claim:

1. A hot-gas engine of Stirling cycle class, the body, or core of the machine, comprised of two cylindrical housings, one within the other, which form the engine block and coolant jacket, at one end of which is a heater head, and at the other a sealed housing containing an electromagnetic-induction rotor; said rotor being affixed to a central shaft which is disposed along the central axis of the cylindrical housing, and which has, at its opposite end, a displacer-drive mechanism which causes the displacer piston to reciprocate within the heater head; and disposed radially about the circumference of the housings, and perpendicular to their axis, a plurality of cylinders, said cylinders housing an equal number of pistons, said cylinders so disposed that one end of each cylinder is fitted through the wall of the inner housing, and the other end fitted through the wall of the outer housing, so that the cylinders are arranged between the inner and outer housings, much like spokes in a wheel, the cylinders forming opposing pairs on several planes along the length of the housings, each plane comprised of two cylinders 180° apart about the circumference of the housings, each plane rotated around the housing from the preceding plane, so that the opposing pairs of cylinders wind around the housing in a spiral arrangement; pistons which reciprocate within said cylinders, said pistons having rollers affixed to their bases which run in contact with elliptical members in the forms of plates with elliptical cutouts in their centers which are connected to the central shaft by means of a spider; said elliptical members being the means by which the motion of the pistons is related to, and dependent upon, the motion of the central shaft; said members and pistons so disposed that all pistons operate in unison, and reciprocate twice for each revolution of the central shaft, just as the displacer piston reciprocates twice with each revolution of the central shaft; said pistons facing inboard, toward the center of the housings, their base rollers, called cam followers, riding in contact against the inner surface of the ellipses, which revolve about the outside of the cylinder housings; a plurality of pumps disposed annularly about the central shaft, by which means lubricant and coolant are circulated, a third, outer housing, about the cylinder housings, which encompasses the elliptical plates and spider, and seals the engine gas-tight; and a stator winding, external to the engine housing and adjacent to the rotor housing, which provides means, in conjunction with the internal electromagnetic-induction rotor, to couple the engine to a load.

2. A hot-gas engine of the Stirling cycle class, the body, or core of the machine, comprised of two cylindrical housings, one within the other, which form the engine block and coolant jacket, at one end of which is a heater head, and at the other a sealed housing containing an electromagnetic-induction rotor; said rotor being affixed to a central shaft which is disposed along the central axis of the cylindrical housing, and which has, at its opposite end, a displacer drive mechanism which causes the displacer piston to reciprocate within the heater head; and disposed radially about the circumference of the housings, and perpendicular to their axis, a plurality of cylinders, said cylinders housing an equal number of pistons, said cylinders so disposed that one end of each cylinder is fitted through the wall of the inner housing, and the other end fitted through the wall of the outer housing, so that the cylinders are arranged between the inner and outer housings, much like spokes in a wheel, the cylinders forming opposing pairs on several planes along the length of the housings, each plane comprised of two cylinders 180° apart about the circumference of the housings, each plane rotated around the housing from the preceding plane, so that the opposing pairs of cylinders wind around the housing in a spiral arrangement; pistons which reciprocate within said cylinders, said pistons having rollers affixed to their bases which run in contact with elliptical members in the form of double-lobed elliptical cams affixed to the central displacer shaft; said elliptical members being the means by which the motion of the pistons is related to, and dependent upon, the motion of the central shaft; said members and pistons so disposed that all pistons operate in unison, and reciprocate twice for each revolution of the central shaft, just as the displacer piston reciprocates twice with each revolution of the central shaft; said pistons facing outboard, away from the central housings, their base rollers, called cam followers, riding in contact against the outer surface of the double-lobed cams, which rotate with the central shaft; a plurality of pumps disposed annularly about the central shaft, by which means lubricant and coolant are circulated; and a stator winding, external to the engine housing and adjacent to the rotor housing, which provides means, in conjunction with the internal electromagnetic-induction rotor, to couple the engine to a load.

* * * * *